United States Patent [19]

Ahern et al.

[11] Patent Number: 4,570,644

[45] Date of Patent: Feb. 18, 1986

[54] CIGARETTE MAKING MACHINE HOPPER

[75] Inventors: Ronald A. Ahern; Derek H. Dyett, both of High Wycombe, England; Francis A. M. Labbe, Neuilly-sur-Seine, France; Godfrey A. Wood, High Wycombe, England

[73] Assignee: Molins PLC, London, England

[21] Appl. No.: 396,879

[22] Filed: Jul. 9, 1982

[30] Foreign Application Priority Data

Jul. 11, 1981 [GB] United Kingdom ..... 8121462

[51] Int. Cl.[4] ..... A24C 5/39

[52] U.S. Cl. ..... 131/109 R; 131/108; 131/909

[58] Field of Search ..... 131/108, 109 R, 109 B, 131/109 AB, 110, 909

[56] References Cited

U.S. PATENT DOCUMENTS

| | | | |
|---|---|---|---|
| 2,989,055 | 6/1961 | Labbe | 131/909 |
| 4,185,644 | 1/1980 | Heitmann et al. | 131/109 R |
| 4,223,685 | 9/1980 | Labbe | 131/109 R |
| 4,235,248 | 11/1980 | Schumacher | 131/108 |
| 4,373,538 | 2/1983 | Steiniger | 131/109 R |

*Primary Examiner*—V. Millin

*Attorney, Agent, or Firm*—John C. Smith, Jr.

[57] ABSTRACT

This application describes various possible modifications in the cigarette machine hopper described in G.B. specification No. 2,045,595. In particular, as shown in FIG. 2, a concave member 126 around a carded roller 23 from which tobacco is removed by a picker roller 24 has a straight land 126A along which the tobacco is propelled by the picker roller.

23 Claims, 4 Drawing Figures

CIGARETTE MAKING MACHINE HOPPER

This patent application is concerned with modifications of the hopper described in our earlier UK patent application published as specification G.B. No. 2,045,595. Various of the modifications can be used separately or in any desired combination.

The modifications will be identified and described with reference to the accompanying drawings. In these drawings.

The hopper shown in FIG. 1 is basically like the hopper described in the above-mentioned prior application, and will not therefore be fully described in this specification. Parts which are substantially unchanged bear the same reference numerals. The modifications are as follows.

Modification 1

Figure 1:
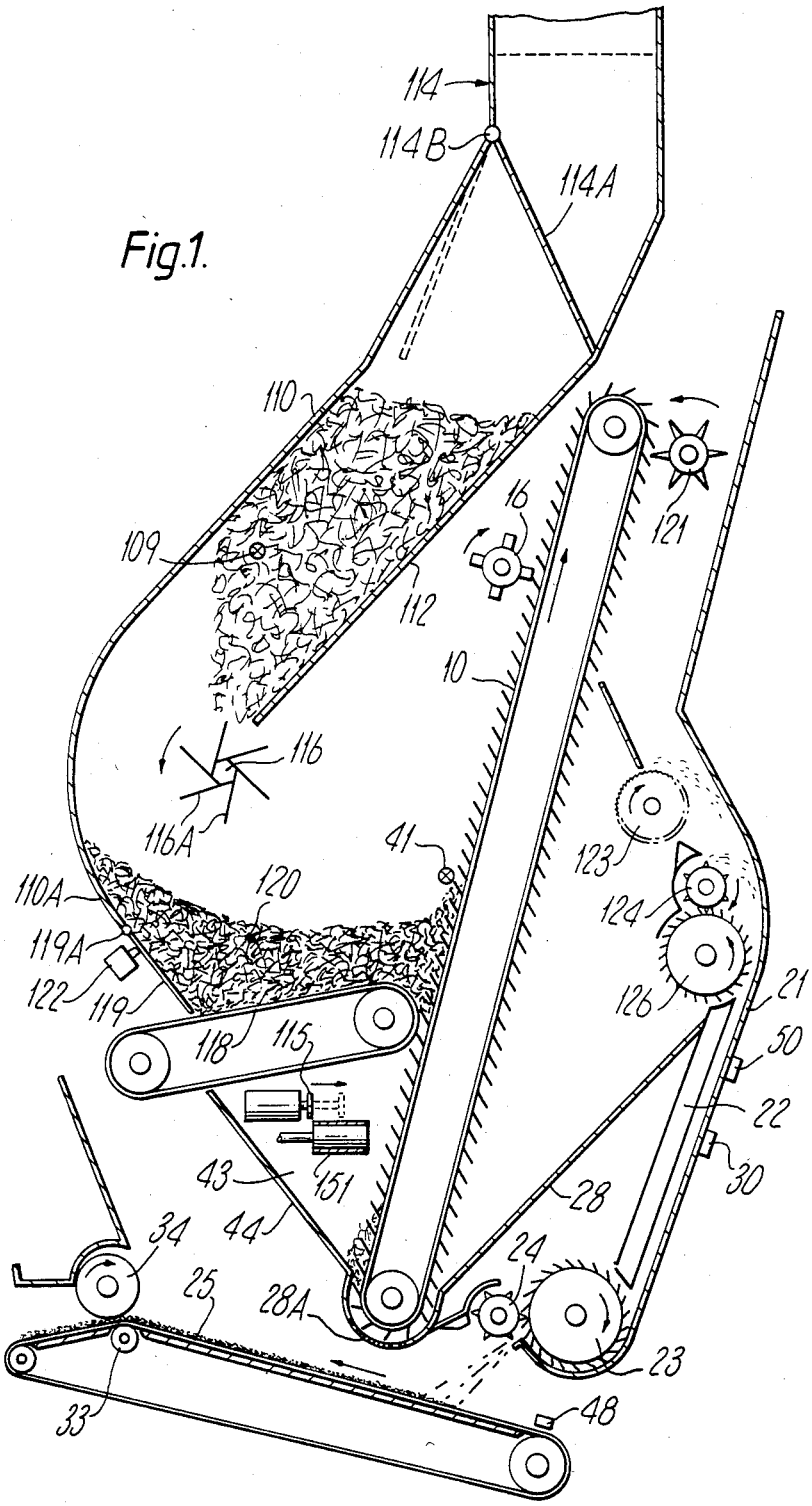
FIG. 1 is a diagrammatic side view of a hopper which is basically like the hopper described in the above-mentioned earlier application.

Tobacco is delivered intermittently by a discharge unit 114 into a buffer space formed by inclined walls 110 and 112. The unit 114 receives tobacco pneumatically and is of a basically well-known type (e.g. as described in British patent specification No. 1,599,397), the point to note being that its tobacco outlet is controlled by a pivoted wall 114A which is inclined to the vertical in the opposite sense to the walls 110 and 112, and is pivoted (at 114B) adjacent to the upper wall 110 of the buffer. Thus, as the wall 114A swings towards the open position (shown in broken outline) it allows the tobacco contained in the discharge unit to slide gently down the lower inclined wall 112 of the buffer. This ensures that tobacco piles up in the buffer 110, 112 with minimum density. Tobacco is delivered by the discharge unit in response to uncovering of a photocell 109.

Modification 2

At the lower end of the buffer 110, 112 there is a spiked feed roller 116 which may have an independent drive motor (not shown) or may be driven, for example, by the motor driving the conveyor 118 but via an electrically disengageable clutch. Tobacco drops from the buffer 110, 112 onto a conveyor band 118 only when the roller 116 is driven (in a counter-clockwise direction). The provision of a feed roller of this general type is known per se. However, it should be noted that the feed roller drive is controlled by a pressure plate 119 forming a back wall for the carpet of tobacco 120 which builds up on the conveyor 118. The plate 119 is pivoted at 119A, and its movement is monitored by a switch or other detector 122 which may include a spring lightly urging the plate 119 in a counter-clockwise direction; alternatively a separate spring may be provided to urge the plate lightly in a counter-clockwise direction. The roller 116 may be arranged to be driven until the pressure of tobacco on the conveyor pushes the plate 119 in a clockwise direction so as to operate the switch 122 which thereupon stops the drive to the roller 116, which drive resumes automatically when the pressure of tobacco on the plate 119 again permits the plate to move away from the switch.

This arrangement helps to ensure that the carpet of tobacco 120 on the conveyor 118 is of relatively low density. As a further modification in this area, the conveyor 118 is shown to be slightly inclined to the horizontal in the same sense that the elevator 10 is inclined to the horizontal, in a manner known per se from our earlier proposals. The upper surface of the conveyor 118 is preferably smooth so that there is a definite limit to the force with which the conveyor can drive the carpet of tobacco 120 towards the elevator 10.

The spikes 116A on the feed roller 116 may be in the form of pins. However, as a preferred alternative, each spike may comprise a triangular piece of sheet metal. The spikes of successive circumferentially spaced rows may be staggered; alternatively they may be aligned to allow the wall 112 to have triangular extensions at its lower end extending into the gaps between the spikes.

It should be noted that the feed roller 116 is arranged to deliver the tobacco onto and close to the inclined lower end portion 110A of the wall 110, at least that part being of very low-friction material. Thus, after a delivery of tobacco by the roller 116, the tobacco piles up along the wall portion 110A; the upper surface of the tobacco slopes downwards from the left-hand end of the conveyor 118, so that the carpet of tobacco 120 presented to the elevator 10 is relatively thin. The piling up of tobacco (as shown) produces sufficient pressure to push back the plate 119 and thus operate the switch 122.

Modification 3

Instead of the vibratory conveyor disclosed in our prior patent application for feeding discard tobacco into the space 43 at the lower end of the elevator 10, one of the following arrangements may be used.

A conveyor band may carry the discard tobacco across the elevator, and may have associated with it a rotary sweeping device or a reciprocating pusher member for pushing the tobacco transversely off the conveyor band at regular intervals chosen so that equal quantities of discard tobacco are fed to various positions across the elevator 10. The example of a reciprocating pusher 150 is shown diagrammatically in FIG. 1, discard tobacco being returned to the hopper by a conveyor 151 from which it is pushed sideways by the pusher 115. The discard tobacco is then carried upwards by the elevator 10 in the manner previously described.

Alternatively, discard tobacco may be returned by a conveyor band of which the upper run is twisted through 90° so that discard tobacco slides off the conveyor band and into the space 43, possibly with the aid of an agitator roller or set of rollers to shake the twisted part of the conveyor band at regular intervals timed to ensure that a quantity of tobacco lies on the band, substantially all the way across the elevator, each time the agitator roller comes into operation to cause the tobacco to slide off the band.

As a simpler alternative, the discard tobacco may be divided into two or more streams fed by separate conveyor bands which terminate at different positions across the elevator, the division of discard tobacco between the conveyor bands being possibly controllable.

In the case of a rotary sweeping device (or of an equivalent pushing device) as mentioned above, the device may be narrower than the elevator so that, at each sweep, discard tobacco is fed across only part of the width of the elevator. Furthermore, in that case, the position of the sweeping device across the width of the hopper may be arranged to alter constantly in response to the height of the tobacco column in the channel 21, 22 (as detected by detectors 30 mounted at various positions across the width of the column) so as to tend to maintain a substantially uniform height of tobacco in the column (i.e. not varying significantly at different positions across the column). In practice, for example, the sweeping device may extend across approximately one third of the width of the elevator and may be movable between three positions, i.e. repsectively two side positions and a middle position, in response to three horizontally spaced height detectors 30.

An alternative way of controlling the distribution of discard tobacco across the elevator is as follows. The discard tobacco is fed in controlled quantities across the width of a vibrating tray (e.g. tray 42 in our prior patent application), it being understood that the tray has an oblique discharge slot whereby it distributes tobacco across the width of the elevator. Discard tobacco is fed onto the tray 42 basically in the manner described in our British published patent application No. 2,023,401. However, at the downstream end of the worm described in that specification, the following additional provision could be made: the trough below the worm would extend beyond the end of the worm to receive discard tobacco pushed into it by the worm, which discard tobacco is then swept sideways off the trough extension and onto the vibrating tray (via the rotary seal) by a paddle member rotating coaxially with the worm at a constant speed, the axial position of the paddle member being controlled to alter the position (across the width of the vibratory tray) at which it operates during each revolution.

In the case of a conveyor band with a sweeping device or pusher member for pushing discard tobacco off the conveyor, the following modification may be made. The speed of the conveyor band is modulated in response to signals from the tobacco height detectors 30, so that the speed is increased when a thinner layer of discard is required to compensate for an excessive height of tobacco in part of the width of the column 21, 22, or vice versa. The sweeping device or pusher member in this case would not operate at regular intervals but instead after predetermined movements of the conveyor band; for example, each operation may be made after a set number of revolutions of the band drive. This would ensure that some discard tobacco would be delivered, at every position across the column, during each operation of the sweeping device or pusher member.

It should be understood that variation of the quantity of discard tobacco fed at various positions across the width of the elevator (i.e. normal to the direction of movement of the elevator) varies the total rate at which tobacco is fed into the channel 21, 22 at various positions across its width for the following reasons. The tobacco carrying capacity of the spikes on the elevator 10 is greatly in excess of the rate at which discard tobacco is fed towards the elevator. Therefore the discard tobacco does not accummulate in the space 43 but is instead carried away by the elevator substantially immediately upon arrival at the elevator, the flow rate at various positions across the elevator being variable as described above. Moreover, the conveyor 118 is controlled by the photocell 41 in response to the maximum height of tobacco on the conveyor 118 in the region adjacent to the elevator. Therefore if less discard tobacco is fed at one location (in response to an indication from the detector 30 that the height of tobacco in the channel at a corresponding location of the channel 21, 22 is excessive), the total tobacco fed into the channel will decline after a short delay and will therefore tend to even out the height of the tobacco in the channel.

Modification 4

An unravelling roller 121 helps to remove tobacco from the elevator 10, and the tobacco drops onto a serrated roller 123 and is then projected horizontally by the roller 123 along a trajectory which allows the tobacco to slide down the rear wall 21 of a channel 21, 22. In this instance, the rear wall 21 at its upper end is curved towards the roller 123; thus tobacco approaches the curved portion of the wall in approximately tangential directions. The presence of the roller 123 reduces the velocity at which the tobacco enters the channel 21, 22 and thus reduces the packing density of the column of tobacco in the channel.

Any lumps in the tobacco are, in a manner which we have previously proposed, picked up by a pin roller 126 from which the lumps are forcefully removed and thereby opened up by the action of a picker roller 124. In contrast with the above-mentioned specification, the picker roller 124 is arranged to return the opened up lumps of tobacco to the wall or ramp 21.

Modification 5

Tobacco is fed from the lower end of the column 21, 22 by a carded roller 23, as in our prior application No. 2,045,595. However, in the region where the tobacco is removed from the carded roller 23 by a picker roller 24, to project the tobacco downwards onto the conveyor 25, there is a modification which is shown in FIG. 2.

Figure 2:
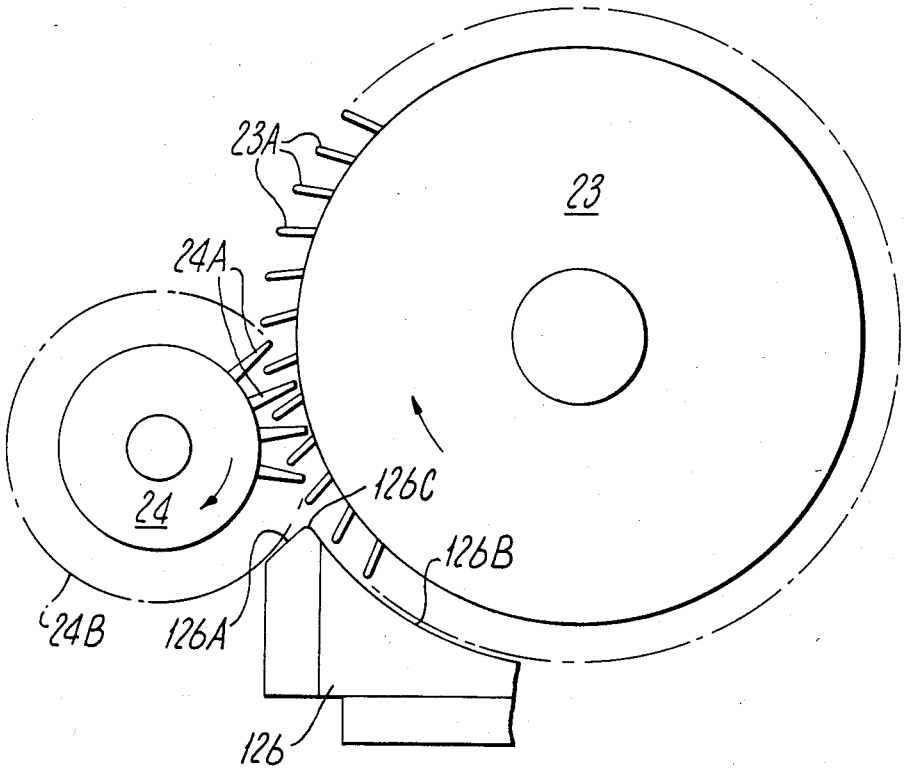
FIG. 2 is an enlargement of part of FIG. 1.

As shown in FIG. 2, a concave member 126 extends around part of the periphery of the carded roller 23 to hold the tobacco on the roller 23. However, it is important to note that, in the region where the picker roller 24 removes the tobacco from the carded roller 23, the member 126 has a substantially flat land 126A, rather than having merely a sharp or rounded edge. The land 126A is joined to the concave surface 126B by a slightly rounded edge portion 126C. More particularly, it should be noted that the land 126A converges towards the path 24B of the tips of the pins 24A of the picker roller. Moreover, it is important to note (as shown particularly in FIG. 2) that the pins 23A on the drum 23 are backwardly inclined in relation to their direction of movement. The angle of inclination (20°) is such that when a pin is adjacent to the land 126A, it is approximately parallel to the land. Thus tobacco can readily slide along and off the pins 23A, under the influence of the picker pins 24A, without suffering any significant breakage. The picker roller rotates at a relatively high speed (e.g. 800 to 1000 r.p.m. ) so that the picker pins make a number of passes through the tobacco as it moves along the land 126A, thus helping to open up the tobacco. The apparent pitch of the pins 23A and 24A as shown in FIG. 2 is half the actual pitch in each row, the pins in alternate circumferential rows being staggered. It will be understood that the picker pins pass between the rows of pins 23A on the roller 23.

Backward inclination of the pins 23A on the roller 23 is made particularly practical by the fact that the carpet of tobacco passing through the channel 21, 22 (see FIG.

1) approaches the roller 23 tangentially. Thus the carpet moves smoothly onto the drum 23 without changing direction. Its thickness decreases (e.g. from 20 mm to 12 mm) and its density thereby increases, but not excessively.

As an alternative, the land 126A may be arranged to diverge from the path 24B, instead of converging.

Modification 6

Figure 3:
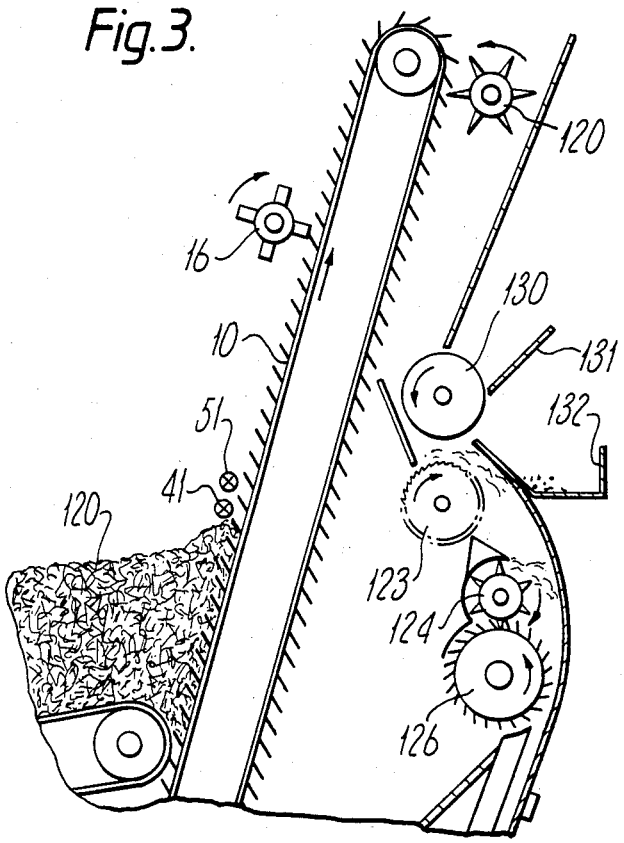
FIG. 3 shows a modification of a hopper which is basically as shown in FIG. 1.

FIG. 3 shows part of a hopper which is basically like that shown in FIG. 1, but with the following modification. Above the serrated roller 123 there is a rotary magnet 130 formed by a thin-walled brass cylinder within which there are stationary permanent magnets. Any ferrous metal objects which may be contained in the tobacco are picked up by the magnet 130, are removed from the magnet with the aid of a scraper 131, and drop into a trough 132.

Modification 7

Figure 4:
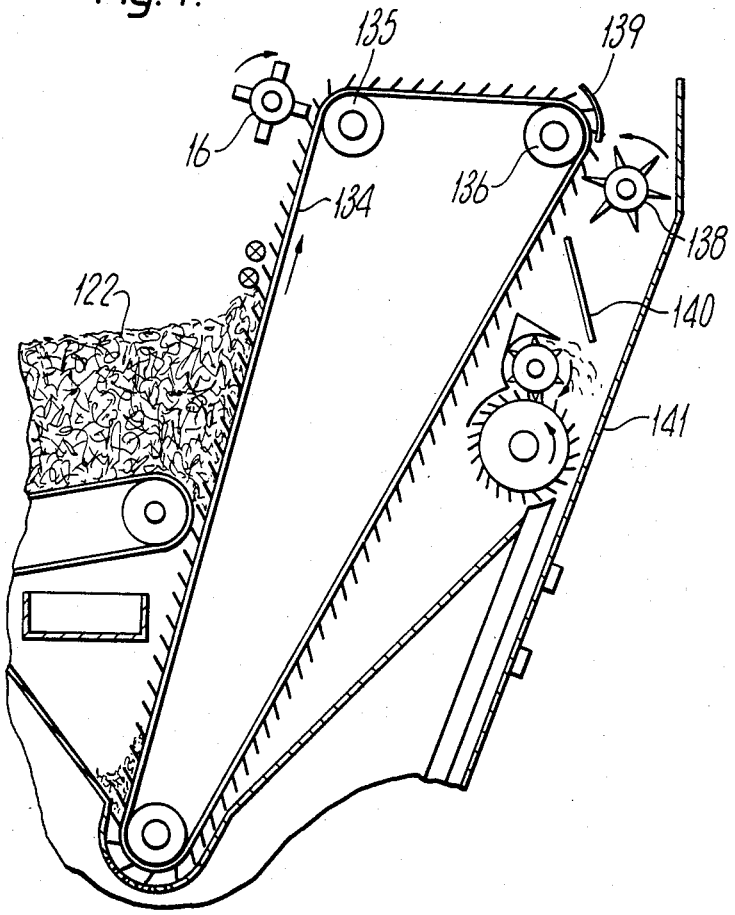
FIG. 4 shows another modification of the hopper shown in FIG. 1.

FIG. 4 shows a different modification in which a spiked elevator 134 is arranged to move firstly along a path inclined to the vertical by approximately 15° as in FIG. 1, then to bend around a pulley 135, and finally to return around a pulley 136 horizontally spaced from the pulley 135. Any protruding lumps of tobacco tend to be knocked off the elevator by the doffer roller 16, which is mounted in this instance at a lower position, and the remaining tobacco is removed from the elevator with the assistance of an unraveller roller 138. Immediately upstream of the roller 138 there is a slotted cowl 139 which is pivoted at its upper end and is lightly spring-loaded towards the elevator. The spikes on the elevator pass through the slots in the cowl.

On leaving the elevator, the tobacco drops onto a ramp 140 and then onto a further ramp 141 of which a downward extension forms the rear wall of a column, as in the previous examples. This enables the tobacco to be dropped from the elevator at a lower height, so that no provision needs to be made to arrest the free-falling tobacco in order to reduce its velocity before it enters the column. This arrangement nevertheless retains an angle of inclination to the vertical of approximately 15° for the elevator run adjacent to the tobacco carpet 122, which is convenient (though this angle may in fact be increased up to 20°).

We claim:

1. A hopper for a cigarette making machine, including a tobacco discharge unit arranged to receive tobacco pneumaticallly and having a pivoted lower wall which is arranged to pivot downwards from a closed position to release tobacco when necessary, and a buffer comprising a lower wall extending downwards from the discharge unit at an inclination to the vertical, the pivoted wall of the discharge unit, when in its closed position, being inclined to the vertical in the opposite sense to said inclination of said lower wall of said buffer with the pivot being at the upper end of the pivoted wall and the lower free end of said pivoted wall being adjacent said lower inclined wall of said buffer such that the tobacco in said discharge unit entering said buffer as said pivoted wall is pivoted downwards from said closed position towards an open position is caused to slide gently past said lower end of said pivoted wall and down said lower inclined wall of said buffer and is accumulated in said buffer with minimum density.

2. A hopper for a cigarette making machine including a buffer formed by substantially parallel downwardly extending walls for receiving tobacco, a conveyor extending below the buffer and arranged to receive tobacco from the buffer and to feed a carpet of the tobacco towards an elevator arranged to feed a metered flow of the tobacco towards a cigarette rod-forming device, characterized in that tobacco is fed onto the conveyor from the buffer by feed means in response to a pressure-sensitive plate extending upwards from the conveyor and arranged to form a back wall for the tobacco on the conveyor, the feed means being arranged to feed tobacco onto the conveyor, when necessary, in a region adjacent to the plate in response to a control signal from the plate indicative of a drop in the tobacco pressure on the plate below a predetermined minimum level.

3. A hopper according to claim 2 wherein said feed means is a rotatably mounted feed roller.

4. A hopper according to claim 2 in which the plate is pivotally mounted and has an associated switch which responds to movement of the plate under the influence of the tobacco pressure and against spring resistance.

5. A hopper for a cigarette making machine including an elevator arranged to feed tobacco from a carpet or mass of tobacco adjacent to the elevator at a first position along the elevator, and means for feeding discard tobacco onto the elevator at a second position which is below the first position, the elevator being arranged to feed tobacco into a downwardly extending channel defined by substantially parallel walls, from which channel tobacco is continuously fed from the lower end thereof towards a cigarette rod forming part of the machine, tobacco being fed into the channel by the elevator under the control of control means responsive to the height of the column of tobacco in the channel so as to maintain the column at a substantially constant height, characterised in that the control means is arranged to detect the height of the tobacco column in the channel at a number of horizontally spaced positions across the channel, and that the means for feeding discard tobacco onto the elevator is controlled by the control means so as to feed a smaller proportion of the discard tobacco at any location corresponding to a higher-than-average height of the tobacco column in the channel.

6. A hopper for a cigarette making machine comprising:

(a) spaced downwardly extending walls defining a channel therebetween for receiving tobacco delivered through the upper end of said channel;

(b) a carded roller mounted for rotation in one direction to feed tobacco continuously from the lower end of said channel;

(c) a picker roller adjacent said carded roller and mounted for rotation in said one direction to remove tobacco from said carded roller during rotation of said carded and picker rollers;

(d) conveyor means spaced from one side of said carded and picker rollers; and (e) means defining a substantially flat land having one end thereof at a position adjacent to the intersection of the perimeters of said carded and picker rollers in the region where said tobacco is removed from said carded roller by said picker roller and extending from said position adjacent to and spaced from the perimeter of said picker roller;

(f) said picker roller being arranged to project tobacco removed from said carded roller along said flat land and onto said conveyor means.

7. A hopper according to claim 6 further comprising means for rotating each of said carded and picker rollers in said one direction.

8. A hopper according to claim 6 wherein the perimeter of said carded roller comprises a plurality of projecting pins, said pins being inclined rearwardly in relation to said one direction of rotation of said carded roller, said rearward inclination of said pins of said carded roller and the orientation of said land being such that during rotation of said carded and picker rollers when each of said pins of said carded roller is adjacent to said land said pin of said carded roller and said land are approximately parallel.

9. A hopper according to claim 6 wherein said channel is substantially tangential to said carded roller.

10. A hopper according to claim 8 wherein said land converges toward the perimeter of said carded roller considered in the direction of movement of said tobacco along said land.

11. A hopper according to claim 6 wherein the perimeters of said carded and picker rollers each comprise a plurality of projecting means, said projecting means of one of said rollers being staggered with respect to said projecting means of the other of said rollers and said carded and picker rollers being positioned relative to each other such that during rotation of both said rollers the paths of said respective projecting means of said rollers overlap.

12. A hopper according to claim 11 wherein the perimeter of said carded roller comprises a plurality of projecting pins arranged in spaced circumferential rows about said carded roller and the perimeter of said picker roller comprises a plurality of projecting pins arranged in spaced circumferential rows about said picker roller, said carded and picker rollers being positioned relative to each other and said rows of pins of said carded and picker rollers being staggered such that the rows of pins of one of said rollers pass between said rows of pins of the other of said rollers during rotation of said picker and carded rollers, said pins of said carded roller being inclined rearwardly in relation to said one direction of rotation of said carded roller, said rearward inclination of said pins of said carded roller and the orientation of said land being such that during rotation of said rollers when each of said pins of said carded roller is adjacent to said land said pin of said carded roller and said land are approximately parallel.

13. A hopper according to claim 12 in which said land converges towards the perimeter of said carded roller considered in the direction of movement of said tobacco along said land.

14. A hopper according to claim 6 wherein said means defining said substantially flat land further defines a concave surface extending about a portion of the periphery of said carded roller to hold tobacco on said carded roller and a slightly rounded edge surface joining one end of said concave surface to to said one end of said substantially flat land.

15. A hopper for a cigarette making machine comprising:

(a) spaced downwardly extending walls defining a channel therebetween for receiving tobacco delivered through the upper end of said channel;

(b) a carded roller mounted for rotation to feed tobacco continuously from the lower end of said channel;

(c) a picker roller adjacent said carded roller and mounted for rotation to remove tobacco from said carded roller during rotation of said carded and picker rollers;

(d) conveyor means spaced from one side of said carded and picker rollers; and (e) means defining a substantially flat land having one end thereof at a position adjacent to the intersection of the perimeters of said carded and picker rollers in the region where said tobacco is removed from said carded roller by said picker roller and extending from said position adjacent to and spaced from the perimeter of said picker roller;

(f) said picker roller being arranged to rotate such that the perimeter thereof moves in a direction from said one end of said flat land along said flat land to project tobacco removed from said carded roller along said flat land and onto said conveyor means.

16. A hopper according to claim 15 further comprising means for rotating said carded and picker rollers.

17. A hopper according to claim 15 wherein the perimeter of said carded roller comprises a plurality of projecting pins, said pins being inclined rearwardly in relation to said one direction of rotation of said carded roller, said rearward inclination of said pins of said carded roller and the orientation of said land being such that during rotation of said carded and picker rollers when each of said pins of said carded roller is adjacent to said land said pin of said carded roller and said land are approximately parallel.

18. A hopper according to claim 15 wherein said channel is substantially tangential to said carded roller.

19. A hopper according to claim 18 wherein said land converges toward the perimeter of said carded roller considered in the direction of movement of said tobacco along said land.

20. A hopper according to claim 15 wherein the perimeters of said carded and picker rollers each comprise a plurality of projecting means, said projecting means of one of said rollers being staggered with respect to said projecting means of the other of said rollers and said carded and picker rollers being positioned relative to each other such that during rotation of both said rollers the paths of said respective projecting means of said rollers overlap.

21. A hopper according to claim 20, wherein the perimeter of said carded roller comprises a plurality of projecting pins arranged in spaced circumferential rows about said carded roller and the perimeter of said picker roller comprises a plurality of projecting pins arranged in spaced circumferential rows about said picker roller, said carded and picker rollers being positioned relative to each other and said rows of pins of said carded and picker rollers being staggered such that the rows of pins of one of said rollers pass between said rows of pins of the other of said rollers during rotation of said picker and carded rollers, said pins of said carded roller being inclined rearwardly in relation to said one direction of rotation of said carded roller, said rearward inclination of said pins of said carded roller and the orientation of said land being such that during rotation of said rollers when each of said pins of said carded roller is adjacent to said land said pin of said carded roller and said land are approximately parallel.

22. A hopper according to claim 21 in which said land converges towards the perimeter of said carded roller considered in the direction of movement of said tobacco along said land.

23. A hopper according to claim 15 wherein said means defining said substantially flat land further defines a concave surface extending about a portion of the periphery of said carded roller to hold tobacco on said carded roller and a slightly rounded edge surface joining one end of said concave surface to said one end of said substantially flat land.

* * * * *